US009955840B2

(12) United States Patent
Schuetz et al.

(10) Patent No.: US 9,955,840 B2
(45) Date of Patent: May 1, 2018

(54) CLEANING TOOL FOR A FLOOR CLEANING APPLIANCE

(71) Applicant: Alfred Kärcher GmbH & Co. KG, Winnenden (DE)

(72) Inventors: Michael Schuetz, Stuttgart (DE); Frank Nonnenmann, Schorndorf (DE); Juergen Merz, Waiblingen (DE); Christian Egler, Weinstadt-Struempfelbach (DE); Thomas Hausner, Stuttgart (DE); Attila Orban, Backnang (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 196 days.

(21) Appl. No.: 15/097,814

(22) Filed: Apr. 13, 2016

(65) Prior Publication Data

US 2016/0220087 A1 Aug. 4, 2016

Related U.S. Application Data

(63) Continuation of application No. PCT/EP2014/067119, filed on Aug. 8, 2014.

(30) Foreign Application Priority Data

Oct. 14, 2013 (DE) ..... 10 2013 111 330

(51) Int. Cl.
*A47L 11/40* (2006.01)
*A46B 13/00* (2006.01)
(Continued)

(52) U.S. Cl.
CPC ..... *A47L 11/4041* (2013.01); *A46B 13/001* (2013.01); *A46B 15/001* (2013.01); *A47L 11/4002* (2013.01); *E01H 1/056* (2013.01)

(58) Field of Classification Search
CPC ..... A47L 11/4041; A47L 11/4002; A46B 13/001; A46B 15/001
See application file for complete search history.

(56) References Cited

U.S. PATENT DOCUMENTS 7,992,245 B2 * 8/2011 Schuetz ..... A47L 11/4041 116/208
2006/0226984 A1 10/2006 Menke
(Continued)

FOREIGN PATENT DOCUMENTS

| | | |
|---|---|---|
| DE | 37 40 215 | 6/1988 |
| DE | 296 20 304 | 1/1997 |
| WO | WO 97/08984 | 3/1997 |

*Primary Examiner* — Shay Karls
(74) *Attorney, Agent, or Firm* — Womble Bond Dickinson (US) LLP

(57) ABSTRACT

A cleaning tool for a floor cleaning appliance is provided, including a main body carrying a cleaning cover which is subject to wear, and including a signal transmitter which provides a wireless signal in dependence upon the degree of wear of the cleaning cover. To be able to detect in a cost-effective manner when a maximum admissible degree of wear of the cleaning cover is reached, the signal transmitter is of rigid construction and fixed to a movable carrying part, the carrying part being held on the main body and being movable from a normal position to an evasive position against a restoring force, the carrying part protruding further from the main body in the normal position than in the evasive position, and the carrying part and/or the signal transmitter contacting the floor surface to be cleaned when a maximum admissible degree of wear of the cleaning cover is reached.

18 Claims, 7 Drawing Sheets

(51) Int. Cl.
*A46B 15/00* (2006.01)
*E01H 1/05* (2006.01)

(56) References Cited

U.S. PATENT DOCUMENTS

| | | | |
|---|---|---|---|
| 2007/0252719 | A1 | 11/2007 | Ray |
| 2010/0263141 | A1 | 10/2010 | Schuetz et al. |
| 2011/0260834 | A1 | 10/2011 | Chapman et al. |
| 2012/0084930 | A1 | 4/2012 | Schuetz et al. |
| 2013/0247938 | A1 | 9/2013 | Walz et al. |

* cited by examiner

CLEANING TOOL FOR A FLOOR CLEANING APPLIANCE

CROSS-REFERENCE TO RELATED APPLICATIONS

This application is a continuation of international application number PCT/EP2014/067119 filed on Aug. 8, 2014 and claims the benefit of German application number 10 2013 111 330.3 filed on Oct. 14, 2013, which are incorporated herein by reference in their entirety and for all purposes.

BACKGROUND OF THE INVENTION

The invention relates to a cleaning tool for a floor cleaning appliance, comprising a main body carrying a cleaning cover which is subject to wear, and comprising a signal transmitter which provides a wireless signal in dependence upon the degree of wear of the cleaning cover.

Floor cleaning appliances, for example, sweeping machines, scrubbing machines or floor polishing machines, comprise a cleaning tool with a main body carrying a cleaning cover. The cleaning cover may, for example, be configured in the form of a bristle cover, a polishing disk or a cleaning pad and is subject to increasing wear during use of the cleaning tool. When a maximum admissible degree of wear is reached, the cleaning tool should be replaced as, otherwise, there is a risk of the floor surface to be cleaned being damaged and, in addition, of the achievable cleaning result being inadequate. The wear of the cleaning cover is often visually monitored by the user. However, in many cases, this involves difficulties as the cleaning tool is often installed in a housing of the floor cleaning appliance and, therefore, cannot be readily seen by the user from the outside.

To detect the degree of wear of a disk brush, it is proposed in WO 97/08984 A1 that the disk brush be mounted on a vertically displaceable linkage, the position of which can be detected by a potentiometer. With increasing wear of the disk brush, it becomes displaced further and further downwards in the direction towards the floor surface to be cleaned. This displacement is detected by the potentiometer and forms a measure of the degree of wear of the disk brush. If the disk brush is replaced, it is necessary to calibrate the position of the new disk brush in order to thereby ensure that the signal of the potentiometer corresponds to the actual degree of wear of the new disk brush.

In DE 10 2009 018 121 A1 it is proposed that a wear value be stored in a memory element of the cleaning tool, the wear value corresponding to the degree of wear of the cleaning tool at the time the wear value is stored, and that this wear value be repeatedly updated.

In DE 10 2007 050 351 A1, it is proposed that the degree of wear of the cleaning cover be detected by means of a sensor element which is arranged together with a transponder on a flexible foil printed circuit. The foil printed circuit protrudes together with the sensor element located thereon from the main body of the cleaning tool and, like the cleaning cover, wears away during use of the cleaning tool. When a maximum degree of wear is reached, the sensor element is destroyed, and, as a result, the wireless signal provided by the transponder, which can be detected by an associated reader, changes.

The provision of a flexible foil printed circuit having arranged thereon a sensor element which is destroyed when a maximum degree of wear of the cleaning cover is reached, makes it possible to detect when the maximum degree of wear of the cleaning cover is reached. However, the arrangement of the sensor element and the transponder on the foil printed circuit involves not inconsiderable costs.

The object of the present invention is to further develop a cleaning tool of the generic kind in such a way that wear of the cleaning cover can be detected in a cost-effective manner.

SUMMARY OF THE INVENTION

This object is accomplished, in accordance with the invention, with a cleaning tool of the kind mentioned at the outset in that the signal transmitter is of rigid construction and is fixed to a movable carrying part, the carrying part being held on the main body and being movable from a normal position to an evasive position against a restoring force, the carrying part protruding further from the main body in the normal position than in the evasive position, and the carrying part and/or the signal transmitter contacting the floor surface to be cleaned when a maximum admissible degree of wear of the cleaning cover is reached.

A rigid signal transmitter which is fixed to a movable carrying part is used in the cleaning tool in accordance with the invention. A standard part such as, for example, a permanent magnet or a transponder, which can be cost-effectively produced in very large numbers, can be used as signal transmitter. The carrying part is held on the main body and can be moved from a normal position against the action of the restoring force to an evasive position. In the normal position, the carrying part protrudes further from the main body than in the evasive position. When a maximum admissible degree of wear of the cleaning cover is reached, the carrying part and/or the signal transmitter contacts the floor surface to be cleaned. This results in the carrying part and/or the signal transmitter being adversely affected by the floor surface upon further use of the cleaning tool. This ultimately causes damage to the carrying part and/or the signal transmitter, which, in turn, leads to a change in the wireless signal provided by the signal transmitter.

It may, for example, be provided that when a maximum admissible degree of wear of the cleaning cover is exceeded, the signal transmitter is damaged or even destroyed by the floor surface or becomes detached from the carrying part.

It is expedient for the signal transmitter to provide a predefined wireless signal until a maximum admissible degree of wear of the cleaning cover is reached and for the signal to change abruptly or stop when the maximum admissible degree of wear of the cleaning cover is exceeded.

The floor surface is cleaned by the cleaning cover contacting the floor surface. The cleaning cover is pressed against the floor surface during the cleaning of the floor surface. For this purpose, the cleaning tool is held, in many cases, movably on the floor cleaning appliance. The force with which the cleaning cover is pressed against the floor surface can often be influenced by the user. Depending on the type of floor surface, the cleaning cover can be pressed with different force against the floor surface. This results in the cleaning cover being compressed to a greater or lesser extent during the cleaning of the floor surface. To prevent the carrying part and/or the signal transmitter from already contacting the floor surface when the cleaning cover is compressed and the floor surface from thereby being damaged before the cleaning cover has reached its maximum admissible degree of wear, the carrying part can be moved against the action of a restoring force from its normal position in the direction of the main body into an evasive position. On the one hand, this has the advantage that the compression of the cleaning cover does not result in the signal transmitter prematurely indicating that the maximum admissible degree of wear of the cleaning cover has been reached, and, on the other hand, the evasive movement of the carrying part ensures that the floor surface to be cleaned is not damaged by the rigid signal transmitter.

With the cleaning tool in accordance with the invention, it is, therefore, possible to reliably detect that the maximum admissible degree of wear of the cleaning cover has been reached without the user having to visually monitor the cleaning cover. It is ensured that the carrying part and/or the signal transmitter are only adversely affected by the floor surface when the maximum admissible degree of wear of the cleaning cover is reached, without a strong compression of the cleaning cover already resulting in such adverse affecting of the carrying part and/or the signal transmitter. In spite of use of a rigid signal transmitter, there is, therefore, no risk of the floor surface being damaged by the signal transmitter or by the carrying part during normal operation of the cleaning tool.

In an advantageous configuration of the invention, the cleaning tool is rotatable about an axis of rotation, and in relation to the axis of rotation of the cleaning tool, the carrying part is movable back and forth in the radial or axial direction between the normal position and the evasive position.

It may, for example, be provided that the cleaning tool is configured as disk brush which is mounted on the floor cleaning appliance for rotation about a substantially vertically aligned axis of rotation, with the carrying part being movable back and forth in the axial direction between the normal position and the evasive position.

It may also be provided that the cleaning tool is constructed as roller brush which is mounted on the floor cleaning appliance for rotation about a substantially horizontally aligned axis of rotation, with the carrying part being movable back and forth in the radial direction between the normal position and the evasive position.

In the normal position of the carrying part, the signal transmitter preferably protrudes from the main body and in its protruding region is completely surrounded by the carrying part. The carrying part forms a protective shell which surrounds the signal transmitter at least in its region protruding from the main body.

It may be provided that in the normal position of the carrying part, the signal transmitter protrudes completely from the main body of the cleaning tool and is completely surrounded by the carrying part.

In an advantageous configuration of the invention, the carrying part forms a protective sleeve which surrounds the signal transmitter in the circumferential direction. The signal transmitter can be inserted into the protective sleeve and fixed in the protective sleeve. The protective sleeve may, for example, be configured in the form of a circular cylinder.

It is expedient for the carrying part to be positionable on the floor surface to be cleaned when a maximum admissible degree of wear of the cleaning cover is reached. Further use of the cleaning tool then results in the carrying part sliding along the floor surface and being mechanically influenced by the floor surface. For example, the carrying part can be abraded by the floor surface. After a short time, the increasing mechanical influence on the carrying part may result in the signal that is provided by the signal transmitter fixed to the carrying part undergoing a change. This signal change can be detected by a signal receiver and it can thereby be indicated to the user that the cleaning cover has exceeded its maximum admissible degree of wear.

It is advantageous for the carrying part to be destroyable by use of the cleaning tool when the maximum admissible degree of wear of the cleaning cover is reached. The carrying part can be destroyed by contact with the floor surface. For example, it may be provided that the carrying part breaks into at least two parts. The fixing of the signal transmitter on the carrying part is thereby adversely affected, which, in turn, results in a change in the signal provided by the signal transmitter after the cleaning cover has reached its maximum admissible degree of wear.

In an advantageous embodiment of the invention, the signal transmitter is removable from the main body when the maximum admissible degree of wear of the cleaning cover is reached. For example, it may be provided that the signal transmitter is ejected from the main body moving relative to the floor surface when the maximum admissible degree of wear of the cleaning cover is reached. This results in the signal transmitter no longer being able to provide a signal detectable by the user. The absence of the signal, therefore, indicates to the user that the cleaning cover has reached its maximum admissible degree of wear.

It is advantageous for the signal transmitter to be configured as transponder. The signal transmitter, therefore, forms a radio communication element, which receives and responds to incoming signals. A wireless transmission channel can be created between the cleaning tool and an external reader of the floor cleaning appliance by means of the transponder. The transponder has a data memory in the form of a read/write memory and may additionally include a control logic device. The transponder preferably has an antenna coil. By means of being inductively coupled to an associated reader, the transponder can be supplied with power and its data memory can be read. It may, however, also be provided that the transponder is equipped with a power source of its own. The person skilled in the art is familiar with such combinations of a transponder and a reader under the term RFID technology (Radio Frequency Identification technology).

The rigid signal transmitter is preferably configured as ferrite core/glass transponder.

As mentioned above, the carrying part can be moved against the action of a restoring force from a normal position to an evasive position. The restoring force is preferably provided by a spring element.

In a preferred configuration of the invention, the carrying part is held in a linearly displaceable manner on the main body. For example, it may be provided that the main body is rotatable about an axis of rotation, and, in relation to the axis of rotation of the main body, the carrying part is held so as to be displaceable in the radial direction.

The carrying part is expediently held in a displaceable manner in a guide part which is fixable to the main body.

The carrying part expediently forms a sleeve which with a front end region protrudes from the main body and with a rear end region is arranged inside the main body. The signal transmitter is expediently arranged in the front end region of the sleeve, and a spring element which is supported on the main body extends into the rear end region of the sleeve. The carrying part constructed as sleeve can be held in a normal position by means of the spring element, and the carrying part can be moved into the evasive position against the spring force of the spring element. In the normal position, the carrying part protrudes further from the main body than in the evasive position.

It may be provided that the main body is of cylindrical configuration and, in relation to the cylinder axis, comprises a radial bore or a bore aligned parallel or at an incline to the radial direction, into which the guide part is insertable.

It is particularly advantageous for the guide part to be latchable to the main body. The guide part may, for example, comprise latching elements which assume a latching position when the guide part is inserted into the main body, so that the guide part is no longer readily removable from the main body.

It is particularly advantageous for the main body to be constructed as hollow cylinder and to comprise a preferably radially aligned bore into which the guide part is insertable, with at least one latching element of the guide part being positionable on an inner side of the hollow-cylindrical main body after insertion of the guide part into the bore.

In an advantageous configuration of the invention, the carrying part comprises a carrying body which accommodates the signal transmitter, and a base body which is connectable to the main body of the cleaning tool and is connected to the carrying body by way of an elastically deformable spring body. The base body can, for example, be inserted into a receptacle of the main body of the cleaning tool, and the carrying body accommodating the signal transmitter can be moved back and forth relative to the base body between a normal position and an evasive position by the provision of the elastically deformable spring body. During the movement from the normal position to the evasive position, the carrying body can be acted upon with a restoring force by the elastically deformable spring body.

It is advantageous for the carrying body, the spring body and the base body to jointly form a one-piece plastic molded part.

The spring body is expediently configured as elastically deformable spring arm. The carrying body is connected to the base body by way of the spring arm.

The main body of the cleaning tool is expediently of cylindrical configuration and at an end face has a recess into which the carrying part is preferably insertable in the axial direction.

It is particularly advantageous for the recess of the main body to be connectable with positive locking to the base body of the carrying part. This facilitates assembly of the carrying part on the main body.

As mentioned above, the cleaning tool may be configured as cleaning brush rotatable about an axis of rotation. In this case, it is advantageous for there to be arranged in the direction of rotation of the cleaning brush, in front of the signal transmitter, cleaning bristles, which cover the signal transmitter at least partially during use of the cleaning tool until a maximum admissible degree of wear of the cleaning bristles is reached. The cleaning bristles project outwardly from a main body of the cleaning brush. In particular, the cleaning bristles can project, in relation to the axis of rotation of the cleaning brush, in the radial direction from the main body of the cleaning brush. The cleaning bristles are bent backwards opposite to the direction of rotation of the cleaning tool by contact with the floor surface to be cleaned. Cleaning bristles arranged in the direction of rotation of the cleaning brush in front of the signal transmitter cover the signal transmitter at least partially until the cleaning bristles have reached their maximum admissible degree of wear. After the maximum admissible degree of wear has been reached, the cleaning bristles can no longer cover the signal transmitter, and so it contacts the floor surface and is thereby adversely affected by the floor surface. This can result in a change and, in particular, in an interruption of the signal provided by the signal transmitter, and this signal change can be recognized by the user.

It is particularly advantageous for the cleaning tool to be configured as roller brush rotatable about an axis of rotation and to have a cylindrical main body which carries a cleaning cover in the form of a bristle cover with a large number of outwardly projecting cleaning bristles between which the signal transmitter fixed to the carrying part is arranged.

The following description of two preferred embodiments of the invention will serve in conjunction with the drawings for further explanation.

DETAILED DESCRIPTION OF THE INVENTION

Figure 1:
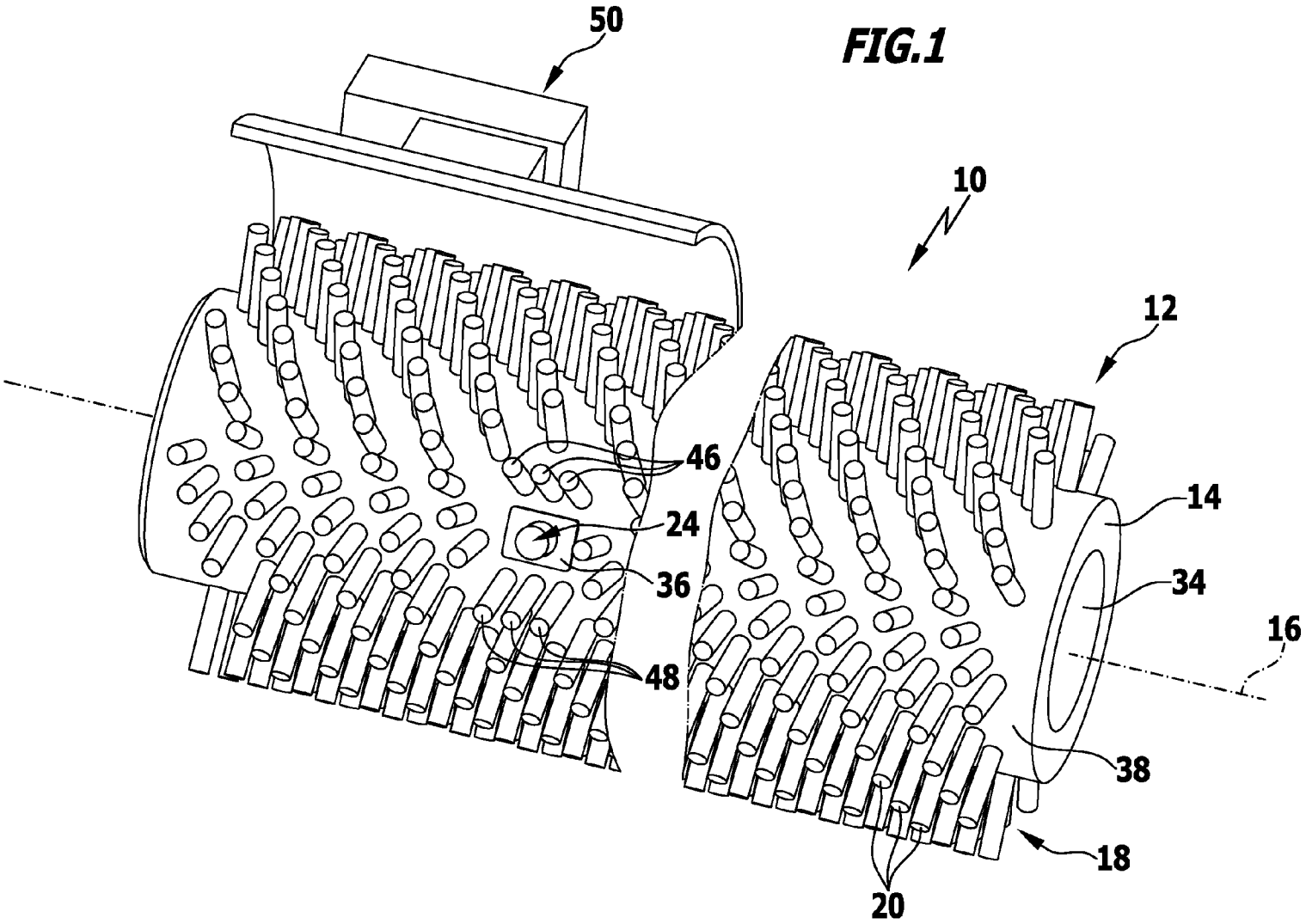
FIG. 1 is a perspective representation of a first embodiment of a cleaning tool in accordance with the invention.
Figure 2:
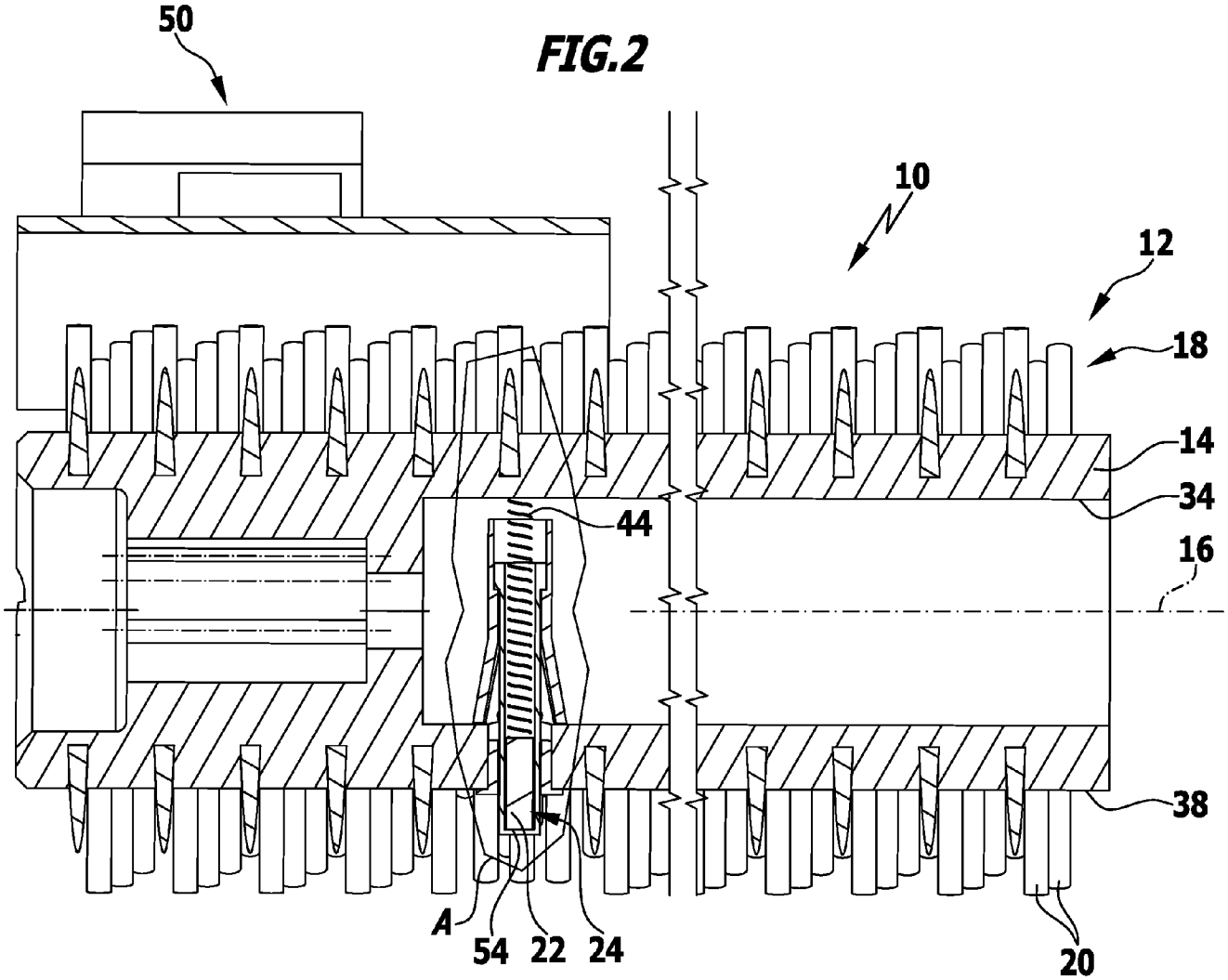
FIG. 2 is a longitudinal sectional view of the cleaning tool shown in FIG. 1.

A first advantageous embodiment of a cleaning tool in accordance with the invention, which is denoted in its entirety by reference numeral 10, is shown schematically in FIGS. 1 to 7. The cleaning tool 10 is configured as roller brush 12 and has a hollow-cylindrical main body 14 which can be mounted on a floor cleaning appliance, known per se, for rotation about an axis of rotation 16.

The main body 14 carries on its outer side a cleaning cover which is configured in the form of a bristle cover 18 and comprises a large number of cleaning bristles 20 which protrude outwardly from the main body 14.

In the course of time, the cleaning bristles 20 wear away during use of the roller brush 12 and become shorter.

When a maximum admissible degree of wear has been reached, this can be wirelessly indicated to the user by a rigid signal transmitter 22. The signal transmitter 22 is configured in the form of a rigidly constructed transponder, in particular, in the form of a ferrite core/glass transponder.

The signal transmitter 22 is fixed in a carrying part configured in the form of a sliding sleeve 24, which in a guide part in the form of a guide sleeve 26 is slidable in the radial direction in relation to the axis of rotation 16 of the roller brush 12. The guide sleeve 26 comprises two latching wings 28, 30 and can be inserted into a radial bore 32 of the hollow-cylindrical main body 14. The latching wings 28, 30 are thereby supported on the inner side 34 of the main body 14, and a radially outwardly facing support flange 36 of the guide sleeve 26 is supported on the outer side 38 of the main body 14. By means of the two latching wings 28, 30 and the support flange 36, the guide sleeve 26 can, therefore, be fixed to the radial bore 32 of the main body 14.

Figure 3:
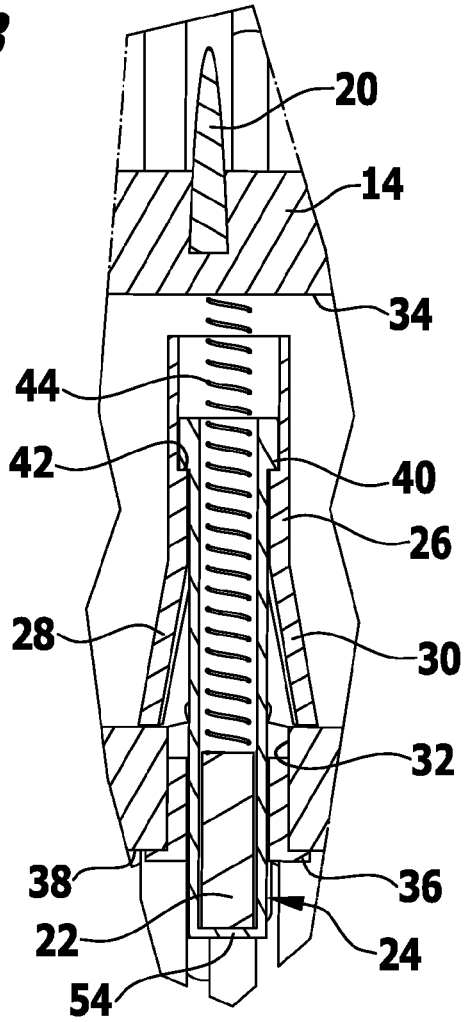
FIG. 3 is an enlarged representation of detail A from FIG. 2.
Figure 4:
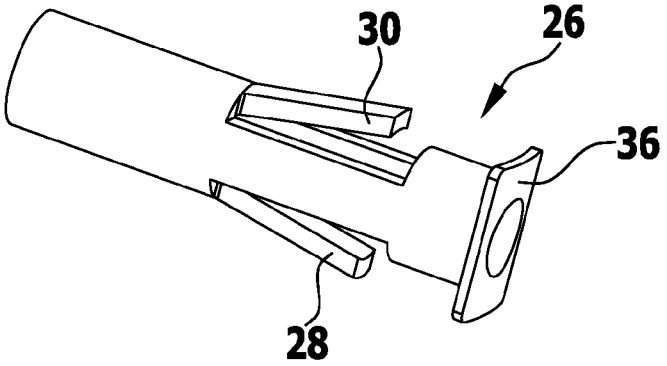
FIG. 4 is a perspective representation of a guide part of the cleaning tool from FIG. 1.

As will be clear, in particular, from FIG. 3, the guide sleeve 26 accommodates the sliding sleeve 24, and the sliding sleeve 24 is supported with a radial extension 40 in the axial direction on a step 42 of the guide sleeve 26. A spring element in the form of a pressure spring 44 extends into the sliding sleeve 24. The pressure spring 44 is supported, on the one hand, on the main body 14 and, on the other hand, on the signal transmitter 22 positioned in the sliding sleeve 24. By means of the pressure spring 44, the sliding sleeve 24 and the signal transmitter 22 are pressed radially out of the main body 14 until the radial extension 40 of the sliding sleeve 24 abuts on the step 42 of the guide sleeve 24. In this position, the sliding sleeve 24 assumes a normal position from which it can be moved against the elastic restoring force of the pressure spring 44 into an evasive position. In the normal position, as shown, for example, in FIG. 5, the sliding sleeve 24 protrudes further from the main body 14 than in the evasive position, which is shown in FIG. 6.

The radial bore 32 is arranged in the region between the cleaning bristles 20 of the roller brush 12, and so the sliding sleeve 24 and the signal transmitter 22 also assume a position between the cleaning bristles 20. This will be clear, in particular, from FIG. 1. In the direction of rotation of the main body 14 in front of and behind the sliding sleeve 24 and the signal transmitter 22, cleaning bristles 46, 48 immediately adjacent to the sliding sleeve 24 and the signal transmitter 22 are arranged on the outer side of the main body 14.

The signal transmitter 22 provides a wireless signal, which can be detected by a reader 50, known per se. The reader 50, like the roller brush 12, is arranged on the floor cleaning appliance and is usually connected to a display device of the floor cleaning appliance.

A floor surface 52 can be cleaned in the usual way by means of the roller brush 12. This is shown schematically in FIGS. 5, 6 and 7. During the cleaning of the floor surface 52, the cleaning bristles 20 of the cleaning brush 12 wear away increasingly and thereby become shorter.

Depending on what force the roller brush 12 is to exert on the floor surface 52 to be cleaned, the roller brush 12 can be brought up to the floor surface 52 to a greater or lesser extent. In a first position, which is shown in FIG. 5, the roller brush 12 exerts a relatively low force on the floor surface 52 to be cleaned, whereas in a second position shown in FIG. 6, the roller brush 12 is closer to the floor surface 52 and, consequently, exerts a greater force on the floor surface 52.

While cleaning the floor surface 52, the cleaning bristles 20 are bent backwards opposite to the direction of rotation of the roller brush 12. The cleaning bristles 46 or 48 immediately adjacent to the sliding sleeve 24 thereby cover the sliding sleeve 24 at least partially, and so the sliding sleeve 24 is unable to directly contact the floor surface 52 as long as the cleaning bristles 24 have not yet reached their maximum admissible degree of wear.

Figure 5:
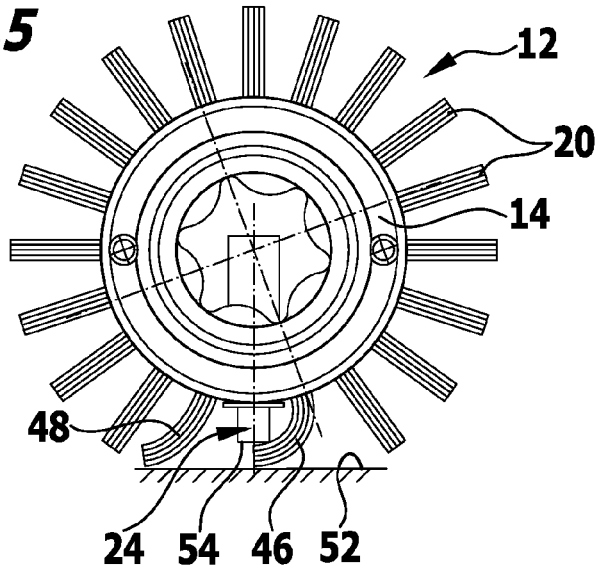
FIG. 5 is a schematic representation of the cleaning tool from FIG. 1 during the cleaning of a floor surface, wherein the cleaning tool is pressed with a relatively low force against the floor surface.
Figure 6:
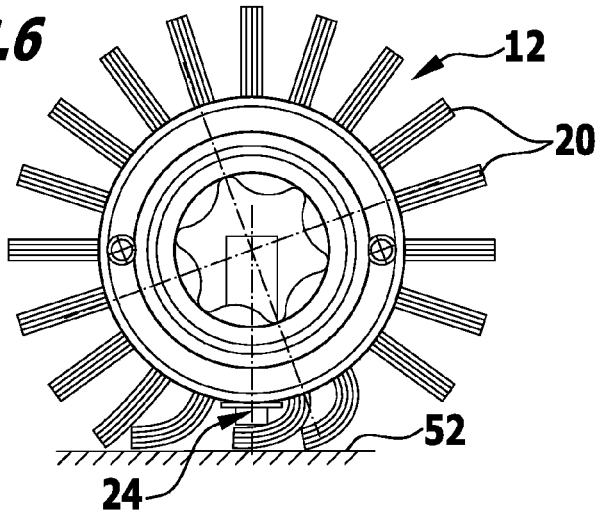
FIG. 6 is a schematic representation of the cleaning tool from FIG. 1 during the cleaning of a floor surface, wherein the cleaning tool is pressed with a relatively high force against the floor surface.
Figure 7:
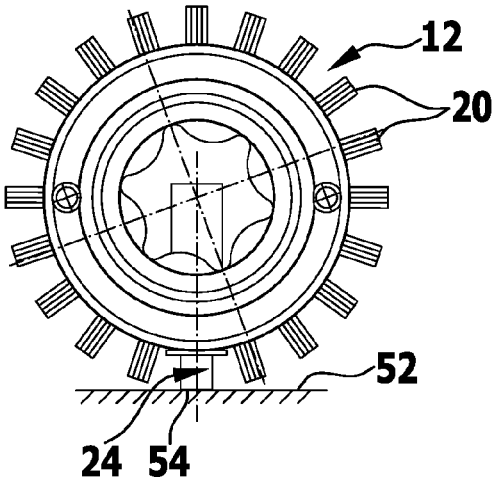
FIG. 7 is a schematic representation of the cleaning tool from FIG. 1 during the cleaning of a floor surface, wherein a cleaning cover of the cleaning tool has reached its maximum degree of wear.
Figure 8:
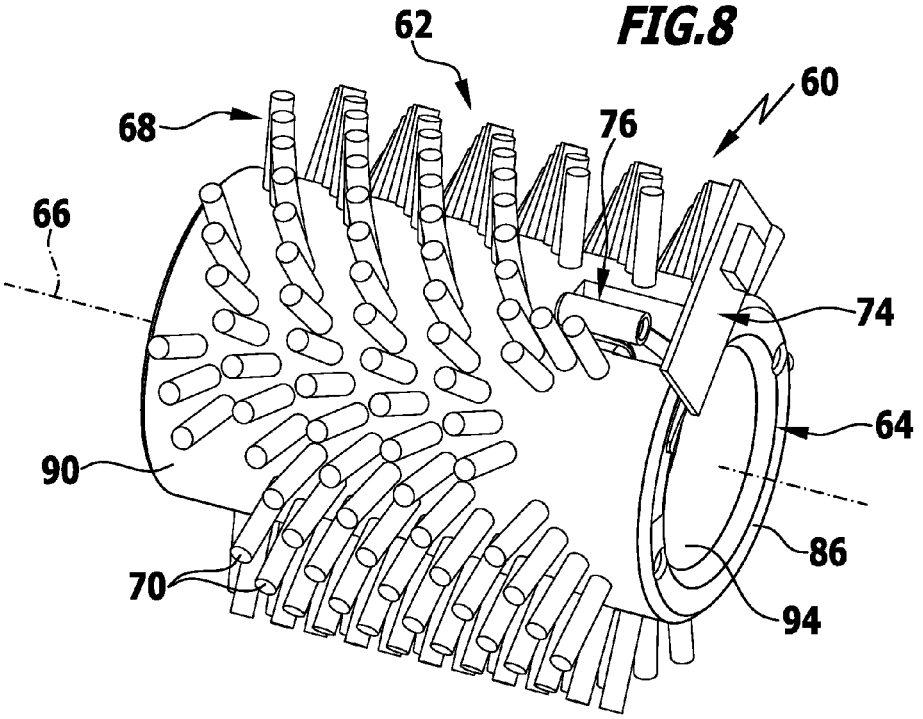
FIG. 8 is a perspective representation of a second embodiment of a cleaning tool in accordance with the invention.
Figure 9:
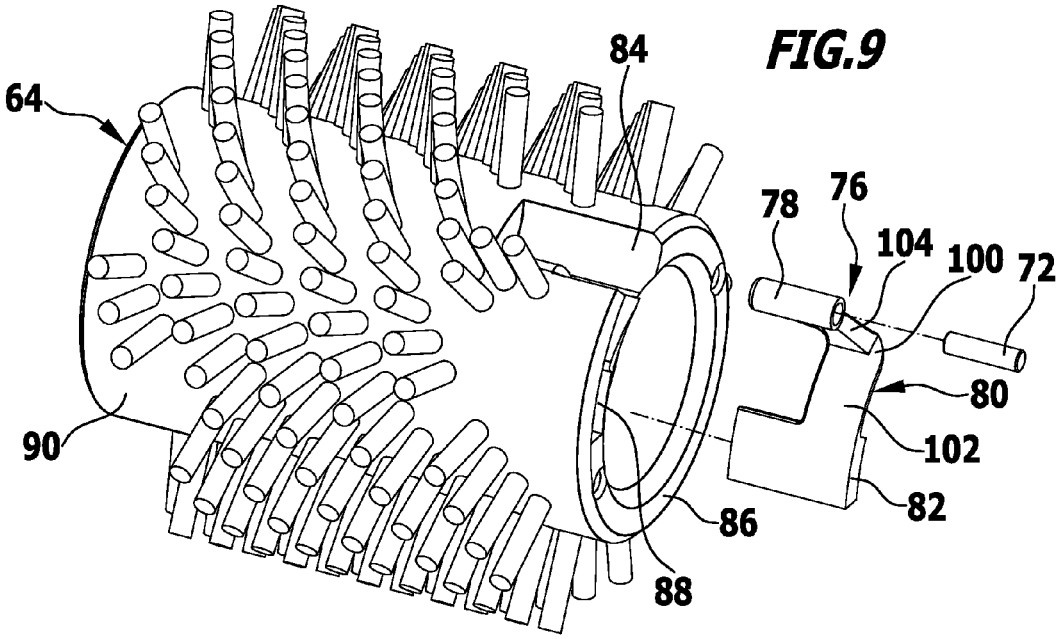
FIG. 9 is a perspective representation of the cleaning tool from FIG. 8 in the manner of an exploded drawing.
Figure 10:
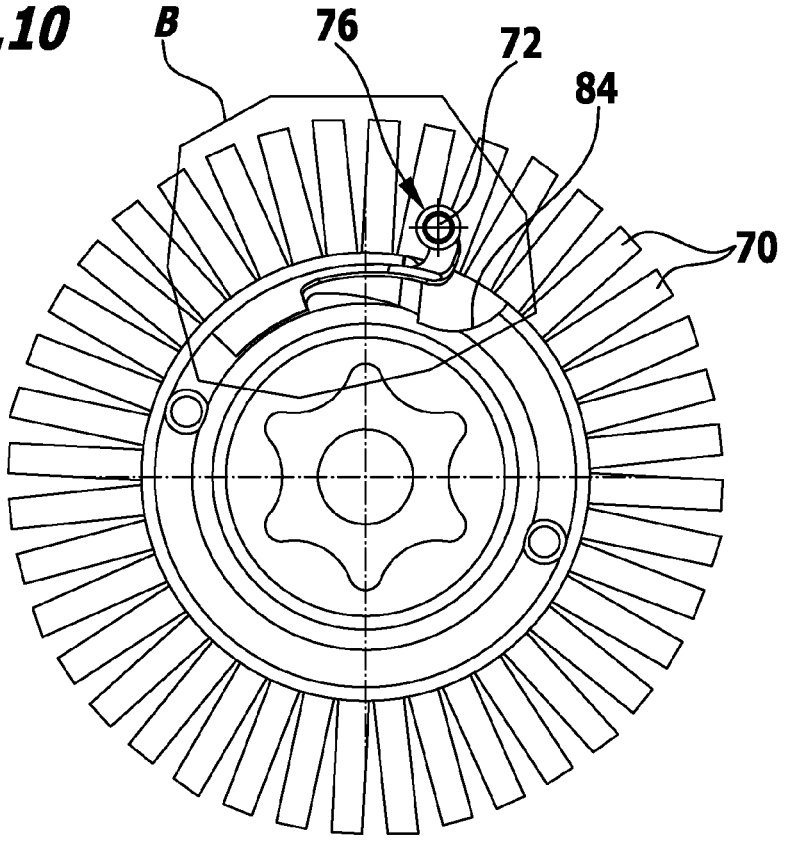
FIG. 10 is a view of an end face of the cleaning tool from FIG. 8.
Figure 11:
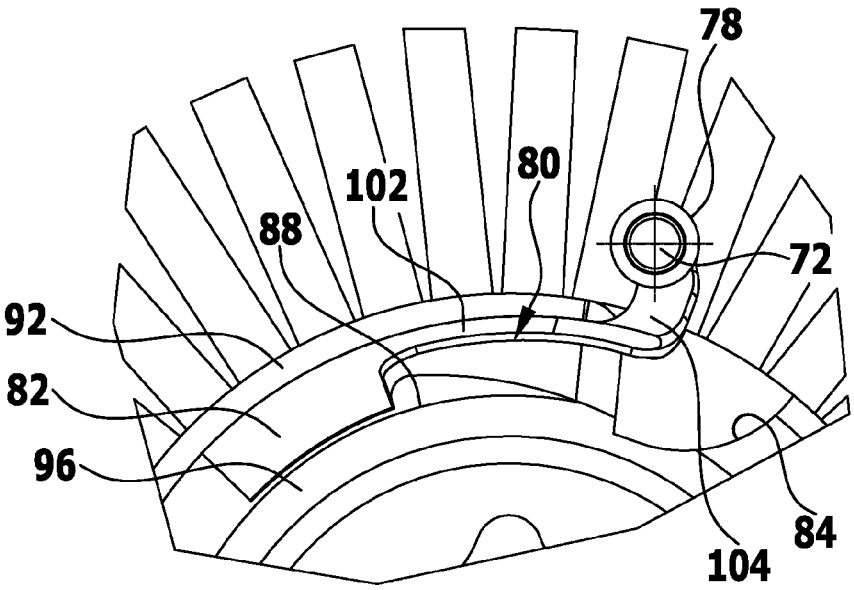
FIG. 11 is an enlarged representation of detail B from FIG. 10.

If a relatively high force is exerted by the roller brush 12 on the floor surface 52, as shown in FIG. 6, the cleaning bristles 20 press the sliding sleeve 24 together with the signal transmitter 22 in relation to the axis of rotation 16 radially inwards into an evasive position in which the sliding sleeve 24 and the signal transmitter 22 protrude to a lesser extent from the main body 14 than in the normal position shown in FIG. 5. The sliding sleeve 24 is also covered by the cleaning bristles 20 in the evasive position, as long as the cleaning bristles 20 have not yet reached their maximum admissible degree of wear.

The consequence of the cleaning bristles 20 reaching the maximum admissible degree of wear is that the sliding sleeve 24 is no longer covered by the cleaning bristles 20. This is shown schematically in FIG. 7 and results in the sliding sleeve 24 directly contacting the floor surface 52 and being mechanically adversely affected by the floor surface 52. The consequence of further use of the roller brush 12 is that an end wall 54 of the sliding sleeve 24 is abraded by the floor surface 52 during further use of the roller brush 12. The signal transmitter 22 is pressed by the pressure spring 44 against the inner side of the end wall 54. Once the end wall 54 has been abraded, the signal transmitter 22 is pushed by the pressure spring 44 out of the sliding sleeve 24, with this movement being supported by the centrifugal force caused by the rotating roller brush 12. This has the consequence that after the maximum admissible degree of wear of the cleaning bristles 20 has been reached, the signal transmitter 22 is ejected from the roller brush 12. This, in turn, has the consequence that a signal can no longer be received by the reader 50. The absence of the signal can be indicated to the user on the display device of the floor cleaning appliance, and so the user receives the information that the cleaning bristles 20 have reached their maximum admissible degree of wear.

By means of the sliding sleeve 24 and the signal transmitter 22 fixed therein, it is, therefore, possible to indicate in a simple way to the user that the maximum admissible degree of wear of the cleaning bristles 20 has been reached, and the signal transmitter 22 together with the sliding sleeve 24 can be moved back and forth between a normal position and an evasive position before the maximum admissible degree of wear of the cleaning bristles 20 is reached. The normal position is assumed by the sliding sleeve 24 and the signal transmitter 22 insofar as the roller brush 12 exerts only a relatively low force on the floor surface 52 to be cleaned. If, however, the roller brush 12 is brought up closer to the floor surface 52 by the user, so that it exerts a greater force on the floor surface 52, the sliding sleeve 24 and the signal transmitter 22 then move into their evasive position. The sliding sleeve 24 is thereby prevented from contacting and damaging the floor surface 52. When the cleaning bristles 20 have reached their maximum admissible degree of wear, the sliding sleeve 24 is then abraded by the floor surface 52 and the signal transmitter 22 is ejected from the roller brush 12. The force with which the roller brush 12 is pressed against the floor surface 52 to be cleaned, therefore, has no influence on the indicating of the maximum admissible degree of wear of the cleaning bristles 20 by the signal transmitter 22.

A second advantageous embodiment of a cleaning tool in accordance with the invention, which is denoted in its entirety by reference numeral 60, is shown in FIGS. 8 to 14. The cleaning tool 60 is configured in the form of a roller brush 62 comprising a hollow-cylindrical main body 64 which can be mounted on a floor cleaning appliance for rotation about an axis of rotation 66. The main body 64 carries a bristle cover 68 with a large number of cleaning bristles 70 on its outer side.

In a manner corresponding to the roller brush 12 explained hereinabove with reference to FIGS. 1 to 7, the roller brush 62 also comprises a rigid signal transmitter 72 which, in the illustrated exemplary embodiment, is configured as ferrite core/glass transponder. The signal transmitter 72 wirelessly supplies a reader 74, known per se and, therefore, shown only schematically in FIG. 8, which can be positioned on an end face of the roller brush 62, with a signal which is dependent upon the degree of wear of the cleaning bristles 70.

For movable mounting of the signal transmitter 72 on the main body 64, the roller brush 62 comprises a carrying part 76 with a hollow-cylindrical carrying body 78, which accommodates the rigid signal transmitter 72 and is connected by way of an elastically deformable spring body 80 to a base body 82. The carrying body 78 forms in combination with the spring body 80 and the base body 82 a one-piece plastic molded part.

The main body 64 of the roller brush 62 has a through-opening 84 which opens into an end face 86. Adjoining the through-opening 84 in the circumferential direction is a recess 88 which is delimited on the outer side 90 of the main body 64 by an outer wall 92 and on the inner side 94 of the main body 64 by an inner wall 96.

An end region of the recess 88 facing away from the through-opening 84 accommodates the base body 82 of the carrying part 76 with positive locking. The carrying body 78 which surrounds the signal transmitter 72 in the circumferential direction assumes a position outside of the through-opening 84, the carrying body 78 being connected to the base body 82 by way of the spring body 80. The spring body 80 forms an L-shaped spring arm 100 with a first spring leg 102 which adjoins the base body 82 and in relation to the axis of rotation 66 of the main body 64 is aligned in the circumferential direction. Adjoining the first spring leg 102 in the region of the through-opening 84 is a radially outwardly directed second spring leg 104, which carries the cylindrical carrying body 78 at its free end.

Figure 12:
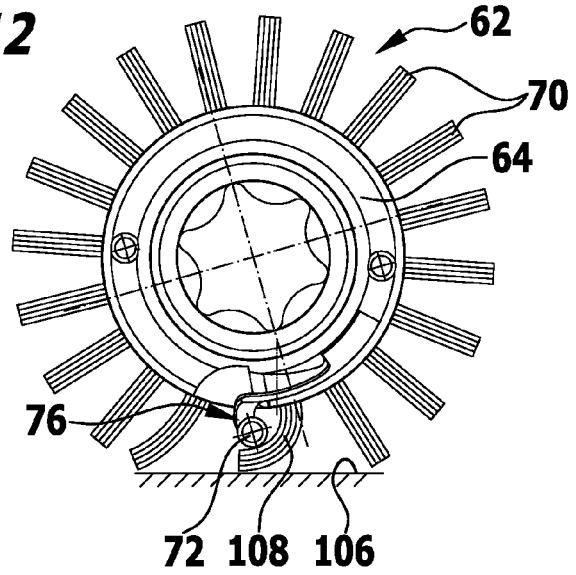
FIG. 12 is a schematic representation of the cleaning tool from FIG. 8 during the cleaning of a floor surface, wherein the cleaning tool is pressed with a relatively low force against the floor surface.
Figure 13:
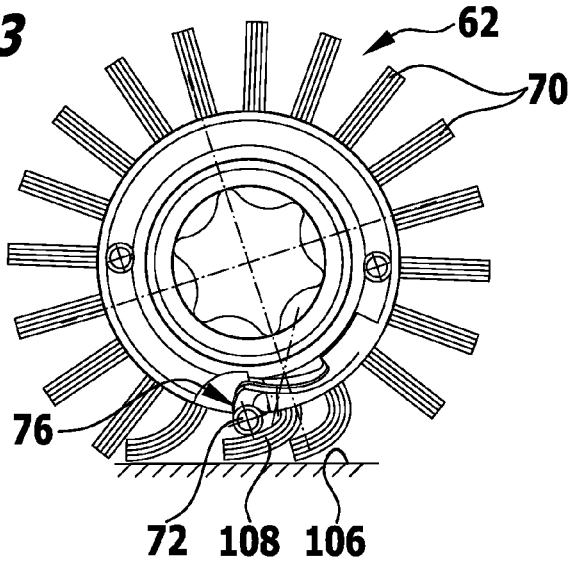
FIG. 13 is a schematic representation of the cleaning tool from FIG. 8 during the cleaning of a floor surface, wherein the cleaning tool is pressed with a relatively high force against the floor surface.
Figure 14:
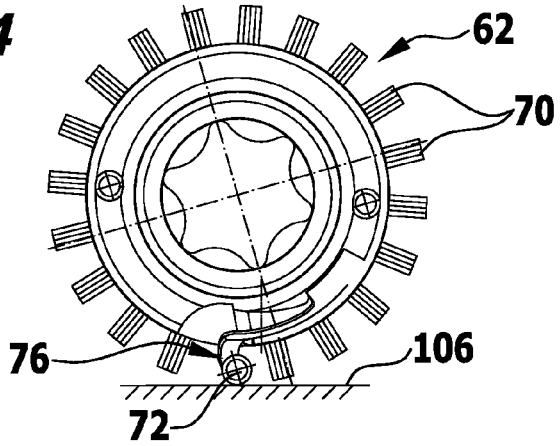
FIG. 14 is a schematic representation of the cleaning tool from FIG. 8 during the cleaning of a floor surface, wherein a cleaning cover of the cleaning tool has reached a maximum degree of wear.

In a manner corresponding to the roller brush 12 explained hereinabove, the roller brush 62 can also be brought up to a floor surface 106 to a greater or lesser extent in order to clean the floor surface 106. When the roller brush 62 assumes a first position, as shown in FIG. 12, it exerts a relatively low force on the floor surface 106 to be cleaned. When the roller brush 62 is brought up closer to the floor surface 106, as shown in FIG. 13, it exerts a greater force on the floor surface 106.

During the cleaning of the floor surface 106, the cleaning bristles 70 are bent backwards opposite to the direction of rotation of the roller brush 62. Cleaning bristles 108 immediately adjacent to the carrying part 76 and the signal transmitter 72 cover the carrying part 76 and, therefore, also the signal transmitter 72 until the cleaning bristles 108 have reached their maximum admissible degree of wear. Depending on the force with which the roller brush 62 is pressed against the floor surface 106, the cleaning bristles 108 immediately adjacent to the carrying part 76 move the carrying part from its normal position shown in FIG. 12 into an evasive position, as shown in FIG. 13. In the evasive position, the carrying part 76 and the signal transmitter 72 protrude to a lesser extent from the main body 64 than in the normal position.

When the cleaning bristles 108 immediately adjacent to the carrying part 76 have reached their maximum admissible degree of wear, they are then shortened to such an extent that they can no longer cover the carrying part 76. This has the consequence that the carrying body 78 contacts the floor surface 106 and is mechanically adversely affected by the floor surface 106. The carrying body 78 is thereby abraded in its circumferential region contacting the floor surface 106 by the floor surface 106. As a consequence of this, the signal transmitter 72 arranged in the carrying body 78 becomes detached from the carrying body 78 after a short time and is ejected from the roller brush 62. Therefore, after the maximum degree of wear of the cleaning bristles 70 has been reached, a signal is no longer supplied to the reader 74 associated with the roller brush 62. The absence of the signal can be indicated to the user on a display device connected to the reader 76, and so the user receives the information that the cleaning bristles 70 have reached their maximum admissible degree of wear.

With the roller brush 62, too, the movable mounting of the rigid signal transmitter 72 ensures that the reaching of the maximum admissible degree of wear of the cleaning bristles 70 independently of the force exerted by the roller brush 72 on the floor surface 106 is only indicated when the cleaning bristles 70 have reached their maximum admissible degree of wear.

The invention claimed is:

1. A cleaning tool for a floor cleaning appliance, comprising a main body carrying a cleaning cover which is subject to wear, and comprising a signal transmitter which provides a wireless signal in dependence upon the degree of wear of the cleaning cover, wherein the signal transmitter is of rigid construction and is fixed to a movable carrying part, the carrying part being held on the main body and being movable from a normal position to an evasive position against a restoring force, the carrying part protruding further from the main body in the normal position than in the evasive position, and at least one of the carrying part and the signal transmitter contacting the floor surface to be cleaned when a maximum admissible degree of wear of the cleaning cover is reached.

2. The cleaning tool in accordance with claim 1, wherein the cleaning tool is rotatable about an axis of rotation, and the carrying part is movable back and forth in the radial or axial direction between the normal position and the evasive position.

3. The cleaning tool in accordance with claim 1, wherein in the normal position of the carrying part, the signal transmitter protrudes from the main body and in its protruding region is surrounded by the carrying part.

4. The cleaning tool in accordance with claim 1, wherein the carrying part forms a protective sleeve which surrounds the signal transmitter in the circumferential direction.

5. The cleaning tool in accordance with claim 1, wherein when a maximum admissible degree of wear of the cleaning cover is reached, the carrying part is destroyable by use of the cleaning tool.

6. The cleaning tool in accordance with claim 1, wherein when the maximum admissible degree of wear of the cleaning cover is reached, the signal transmitter is removable from the main body.

7. The cleaning tool in accordance with claim 1, wherein the signal transmitter is configured as transponder.

8. The cleaning tool in accordance with claim 1, wherein the carrying part is held in a linearly displaceable manner on the main body.

9. The cleaning tool in accordance with claim 8, wherein the carrying part is held in a displaceable manner in a guide part which is fixable to the main body.

10. The cleaning tool in accordance with claim 9, wherein the main body is of cylindrical configuration and comprises a bore into which the guide part is insertable.

11. The cleaning tool in accordance with claim 10, wherein the guide part is latchable to the main body.

12. The cleaning tool in accordance with claim 8, wherein the carrying part forms a sleeve which with a front end region protrudes from the main body and with a rear end region is arranged inside the main body, the signal transmitter being arranged in the front end region, and a spring element extending into the rear end region.

13. The cleaning tool in accordance with claim 1, wherein the carrying part comprises a carrying body which accommodates the signal transmitter, and a base body which is connectable to the main body and is connected to the carrying body by way of an elastically deformable spring body.

14. The cleaning tool in accordance with claim 13, wherein the carrying body, the spring body and the base body jointly form a one-piece plastic molded part.

15. The cleaning tool in accordance with claim 13, wherein the spring body is configured as elastically deformable spring arm.

16. The cleaning tool in accordance with claim 13, wherein the main body is of cylindrical configuration and at an end face has a recess into which the carrying part is insertable.

17. The cleaning tool in accordance with claim 1, wherein the cleaning tool is configured as cleaning brush rotatable about an axis of rotation, and arranged in the direction of rotation of the cleaning brush in front of the signal transmitter are cleaning bristles which cover the signal transmitter at least partially during use of the cleaning tool until a maximum admissible degree of wear of the cleaning bristles is reached.

18. The cleaning tool in accordance with claim 1, wherein the cleaning tool is configured as roller brush rotatable about an axis of rotation with a cylindrical main body which carries a cleaning cover in the form of a bristle cover with a large number of outwardly projecting cleaning bristles between which the signal transmitter fixed to the carrying part is arranged.

* * * * *